US009144704B1

(12) United States Patent
Abelbeck

(10) Patent No.: US 9,144,704 B1
(45) Date of Patent: Sep. 29, 2015

(54) CONTROL SYSTEM AND EXERCISE DEVICE

(76) Inventor: Kevin G. Abelbeck, Fort Collins, CO (US)

( * ) Notice: Subject to any disclaimer, the term of this patent is extended or adjusted under 35 U.S.C. 154(b) by 670 days.

(21) Appl. No.: 13/385,630

(22) Filed: Feb. 28, 2012

Related U.S. Application Data

(60) Provisional application No. 61/464,669, filed on Mar. 7, 2011.

(51) Int. Cl.

| | |
|---|---|
| ***A63B 21/08*** | (2006.01) |
| ***A63B 21/072*** | (2006.01) |
| ***A63B 21/06*** | (2006.01) |
| ***A63B 21/062*** | (2006.01) |
| ***A63B 23/12*** | (2006.01) |

(52) U.S. Cl.
CPC ..... *A63B 21/08* (2013.01); *A63B 21/0601* (2013.01); *A63B 21/062* (2013.01); *A63B 21/0724* (2013.01); *A63B 21/0728* (2013.01); *A63B 23/12* (2013.01)

(58) Field of Classification Search
CPC ..... A63B 21/0611; A63B 2021/0614; A63B 21/00072; A63B 21/0601; A63B 21/0615–21/0618; A63B 21/062; A63B 21/08; A63B 23/12; A63B 21/0724; A63B 21/0728; A63B 71/0054; A63B 2071/0063
USPC ..... 482/93–94, 97–98, 118, 133, 135–137, 482/140, 142, 144; 434/251; 473/441
See application file for complete search history.

(56) References Cited

U.S. PATENT DOCUMENTS

| | | | | |
|---|---|---|---|---|
| 4,369,966 | A * | 1/1983 | Silberman et al. | 482/38 |
| 4,854,578 | A * | 8/1989 | Fulks | 482/100 |
| 5,833,575 | A * | 11/1998 | Holslag | 482/51 |
| 7,976,439 | B2 | 7/2011 | Abelbeck | |

* cited by examiner

*Primary Examiner* — Loan H Thanh
*Assistant Examiner* — Jennifer M Deichl

(57) ABSTRACT

A control system including a mounting frame adapted to receive the exercise device and a base frame coupled to the mounting frame. This combination may provide a controlled, pre-defined movement of the mounting frame, and therefore the exercise device, relative to the base frame and a user. The control system may also include a platform mounted to the base frame and adapted to support the user. This platform may include a platform cushion, which may be comprised of a resilient mat and a foam cushion, positioned to support the bumper of the exercise device. The platform may also include a deck adapted to support the weight of the user. The deck may be positioned distal to the platform cushion as it relates to the base frame.

11 Claims, 11 Drawing Sheets

CONTROL SYSTEM AND EXERCISE DEVICE

CROSS-REFERENCE TO RELATED APPLICATION DATA

Priority is claimed under 35 U.S.C. §119(e) to U.S. Provisional Application No. 61/464,669, filed on Mar. 7, 2011, which is incorporated by reference herein.

FIELD OF THE INVENTION

The present invention generally relates to exercise devices and, more particularly, to exercise systems and systems for enabling controlled movement of exercise devices.

BACKGROUND OF THE INVENTION

Functional strength training may be defined as training which involves movements which relate to functional activities found in certain activities. Functional training for athletes has gained attention as there is an increased value of training under more real world conditions, as opposed to the more "sterile" lifts performed only in the weight room. For example, a bench press may not be considered "functional" unless you are pushing a car off your chest, with your back supported. Therefore this arm extension movement is likely not found in most daily activities. On the other hand, picking up an object and carrying it, as we as a species have been doing for decades, could be considered functional.

One of the most complete, whole body functional movements is picking up one end of an implement and flipping it over. The most commonly used implement to be flipped is a large tractor or truck tire. There are inherent risks for injury with large tires, one of which is controlling the movement during the lifting phases of the flip as well as the inherent lack of control after the throwing movement of the flip as the object falls back to the ground. What is absent in the art is a system that allows an exercise device to be flipped or lifted and to be docked into a control system, thereby creating an exercise system that allows for explosive throwing movements by the user. By allowing for control of the exercise device, this dynamic and explosive movement of flipping an exercise device may be safely brought into the weight room, which it has not previously, even in potentially crowded conditions.

SUMMARY OF THE INVENTION

The present invention is a control system for an exercise device of the type including a frame symmetrical about at least one plane and further including the bumper, the control system including a mounting frame adapted to receive the exercise device and a base frame coupled to the mounting frame. This combination provides a pre-defined movement of the mounting frame relative to the base frame. The control system may also include a platform mounted to the base frame and adapted to support a user. This platform may include a platform cushion, which may be comprised of a resilient mat and a foam cushion, positioned to support the bumper of the exercise device on the platform. The platform may also include deck adapted to support the weight of the user. The deck may be positioned distal to the platform cushion as it relates to the base frame.

The mounting frame of the control system may include a swing link coupled to the base frame. The mounting frame may also include a mounting link which may be coupled to the swing link. A guide link may be provided, which may be coupled to the base frame and the mounting link, thereby controlling a portion of the mounting link to be constrained to substantially vertical movement. The guide link may also be comprised of a linear guide mounted to the base frame and receiving a portion of the mounting frame, thereby providing for substantially vertical tracking of a portion of the mounting link. The mounting link may include a mounting stud adapted to secure the exercise device. The mounting frame may be movably coupled to the base frame by way of a main bearing supported on a bearing damper. In one embodiment of the invention, two bearing dampers may be provided with the bearing mounted to the bearing dampers, the two bearing dampers capturing a portion of the base frame there between. The bearing damper may be comprised of a compliant material.

The present invention may also include the exercise device with the control system, thereby providing an exercise system. This exercise system may include the exercise device of the type including a frame symmetrical about at least one plane and including a bumper. A mounting frame may be provided which has been adapted to receive the exercise device. A base frame may be included which has been adapted to receive the mounting frame while providing articulate communication between the base frame and the mounting frame. The exercise system may further comprise a platform mounted to the base frame, the platform adapted to support a user.

The present invention may also include a method of exercise. This method may include the control system and exercise device as previously noted and further presented herein. The method may further include the steps of: a user grasping the exercise device and lifting one end of the exercise device, while an opposite end is guided by the control system. This method may then include flipping the exercise device over to a side opposite relative to the user, the exercise device being guided by the control system.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein, without necessarily achieving other advantages, as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
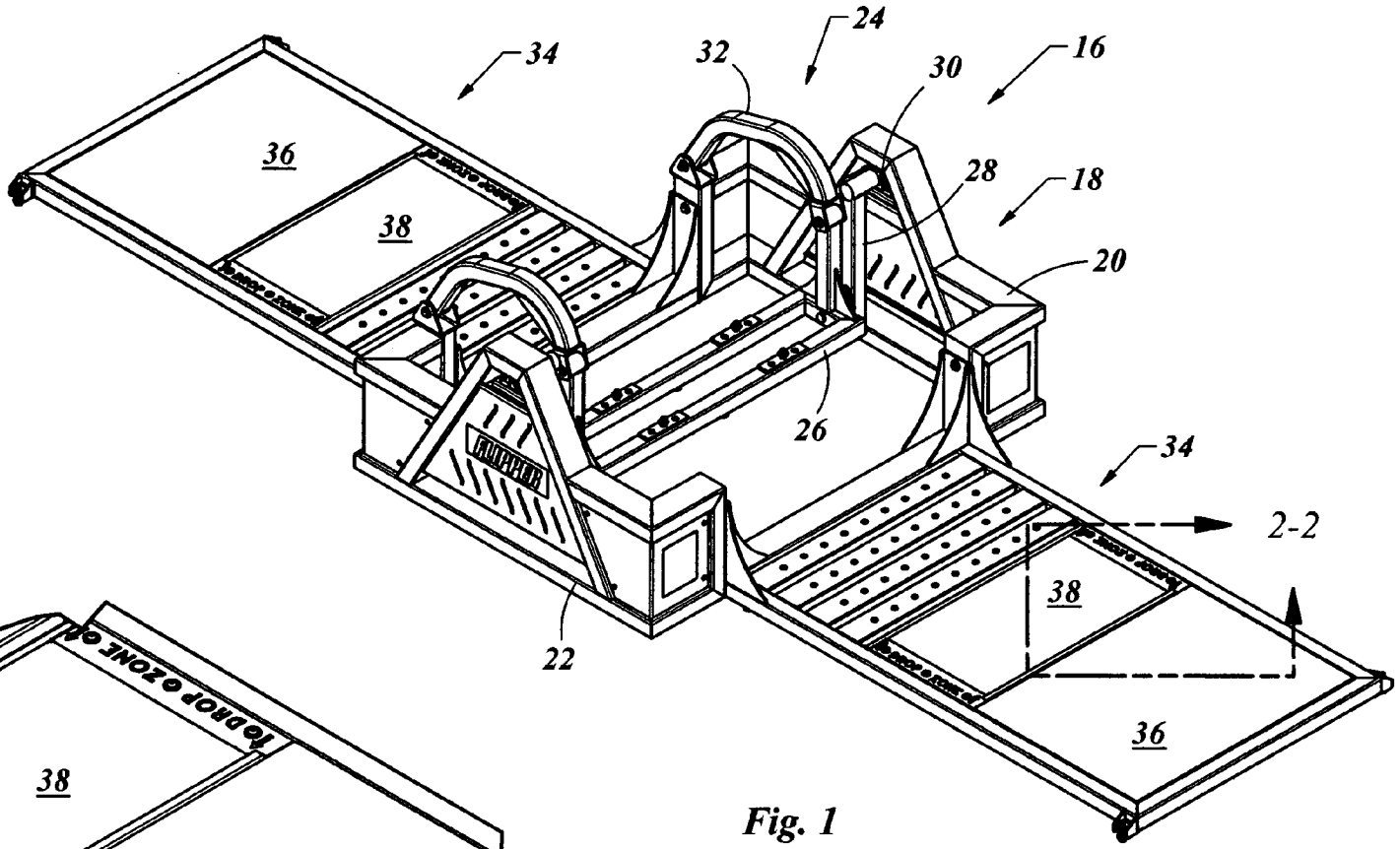
FIG. 1 is an isometric view of a control system which may be used with an exercise device in accordance with the present invention.
Figure 2:
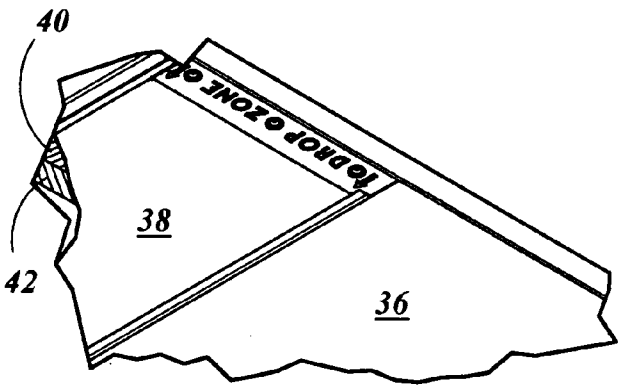
FIG. 2 is a detailed view of the device of FIG. 1 cut along line 2-2, showing a section of the deck and cushion in more detail.
Figure 3:
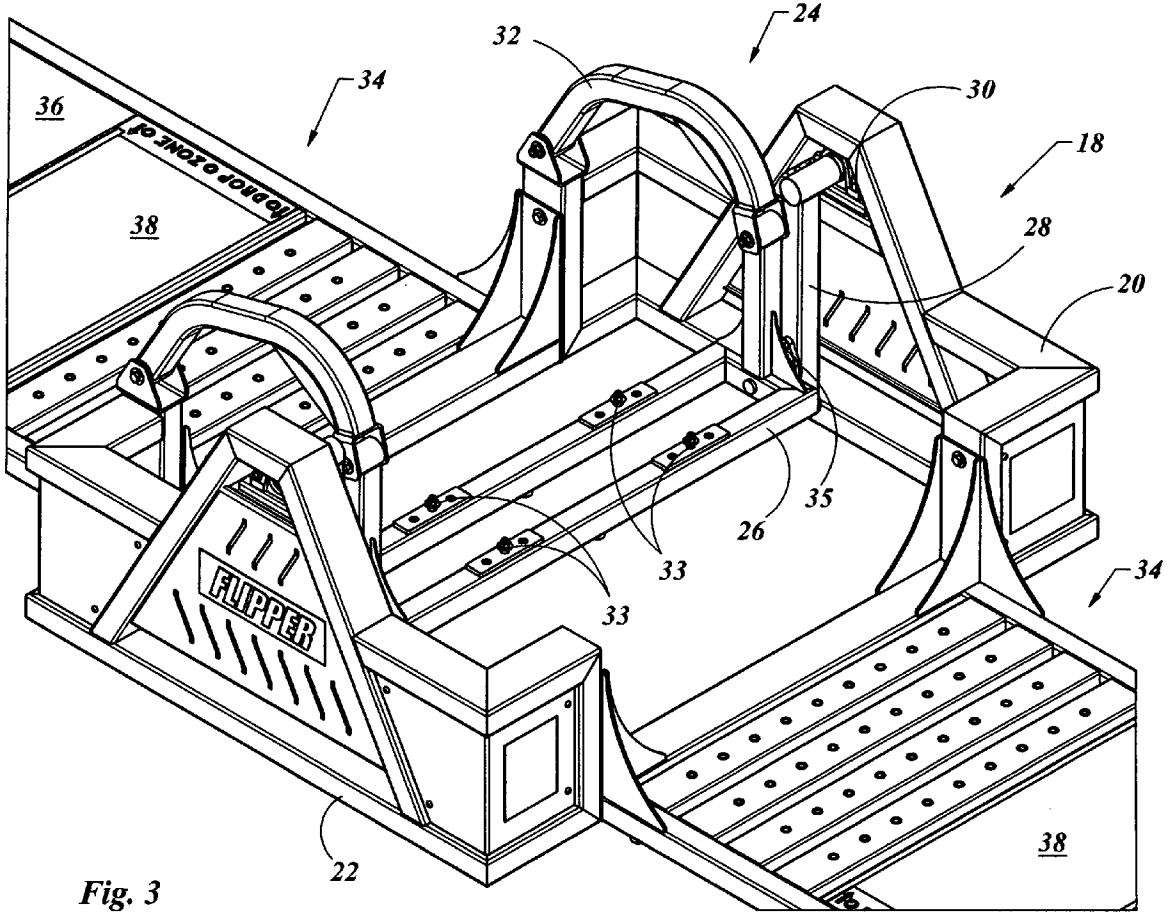
FIG. 3 is an isometric view of the base frames and mounting frame of the control system of FIG. 1.

With reference to the illustrative drawings, and particularly to FIGS. 1, 2 and 3, there is shown a control system 16 for an exercise device. The control system 16 is shown in FIG. 1 and in more detail in FIGS. 2-3. The control system 16 is shown here to include a base frame 18, here being comprised of a right base frame 20 and a left base frame 22. A mounting frame 24 may be provided as being movably mounted to the base frame 18. The mounting frame 24 may include a mounting link 26 coupled to a swing link 28. The swing link 28 may be journaled to the base frame 18 by main bearings 30. In that the mounting link 26 is movably mounted to the swing link 28 by swing mounting bearing 35, which is movably mounted to the base frame 18, the mounting link 26 may include an additional constraint in order to maintain a defined orientation with respect to the base frame 18 as the swing link 28 moves with respect to the base frame 18. This added constraint to the mounting link 26 may be provided by the guide link 32. In this embodiment, the guide link 32 is pivotally coupled to the mounting link 26 and the base frame 18. Two or more mounting studs 33 may be provided in the mounting frame 26 to facilitate securing an exercise device to the mounting link 26 of the mounting frame 24. The specific function of these elements will become clear later in the disclosure.

Another element that may be included in the control system is the addition of one, or in this case two, platforms 34. The platform 34 may serve more than one purpose. The platforms 34 may provide a stable support for a user. The user may stand on a deck 36, which may be mounted to the platform 34. The deck 36 may be positioned distally to a platform cushion 38. When an exercise device is docked into the control system 16, by way of the mounting link 26, the platform cushion 38 may provide the benefit of dissipating some of the energy of impact between the exercise device and a platform 34. The platform cushion 38 may be comprised of two layers, the top layer 40 being comprised of a resilient mat and a lower layer 42 being comprised of a foam cushion. Any object that may impact the platform cushion 38 would contact the resilient mat 40, specifically designed to accommodate pressure and abrasion caused by impact from the object. In the case of this disclosure, an exercise device (not shown in this view) may be the object to impact with the platform cushion 38. The foam cushion 42 acts as an energy damping system. In this way, some of the energy from the impact of the exercise device to the platform 34 is dissipated through the platform cushion 38. The user may maintain their position on the deck 36, safely out of range of the movement of the exercise device.

Figure 4:
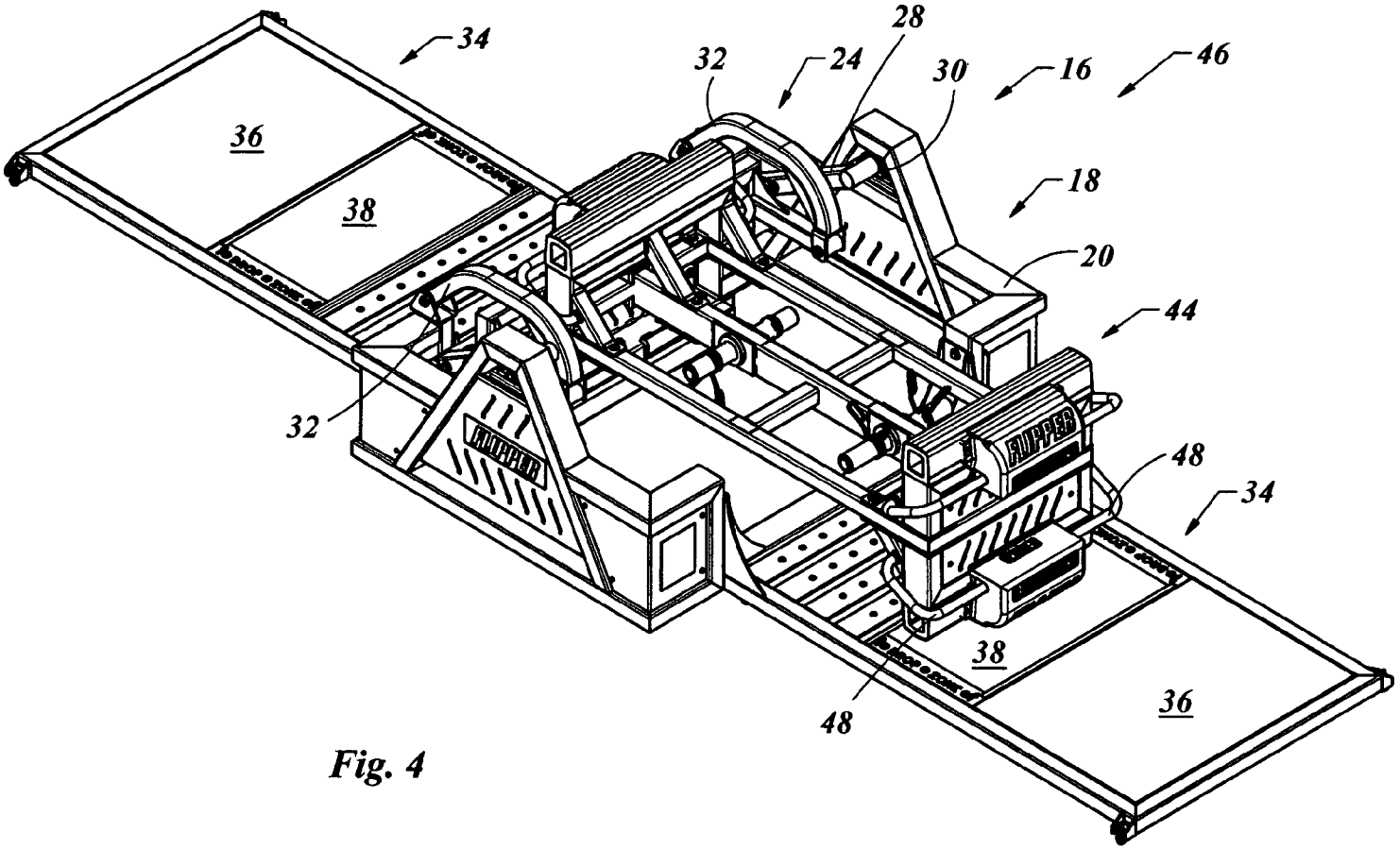
FIG. 4 is an isometric view of the device of FIG. 1 with an exercise device docked therein and positioned in a starting position.

With reference to FIGS. 4-8 an exercise device 44 has been added to the control system 16, thereby creating an exercise system 46, which more clearly depicts a use of the control system 16. As is shown in FIG. 4, one end of the exercise device 44 is secured to the mounting frame 24. The other end of the exercise device 44 may be supported on the platform cushion 38 of the platform 34, as shown here. A user may stand with their feet on the deck 36, adjacent to the exercise device 44 and supported on the platform 34. The user may then grasp the handles 48 of the exercise device 44 and lift that end of the exercise device 44 away from the platform 34.

Figure 5:
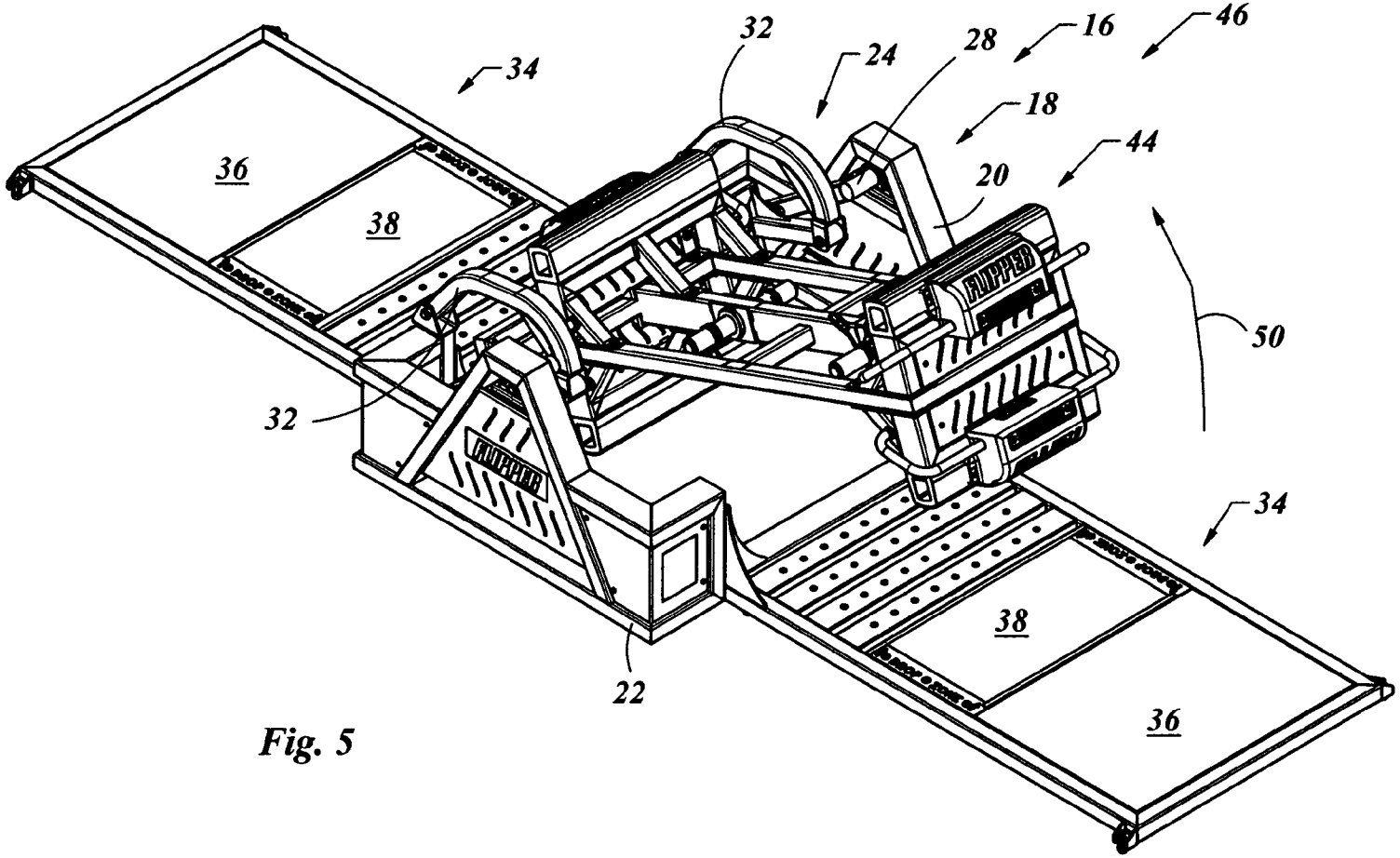
FIG. 5 is an isometric view of the device of FIG. 3 as it may be used with the exercise device passing through a portion of its range of motion.
Figure 6:
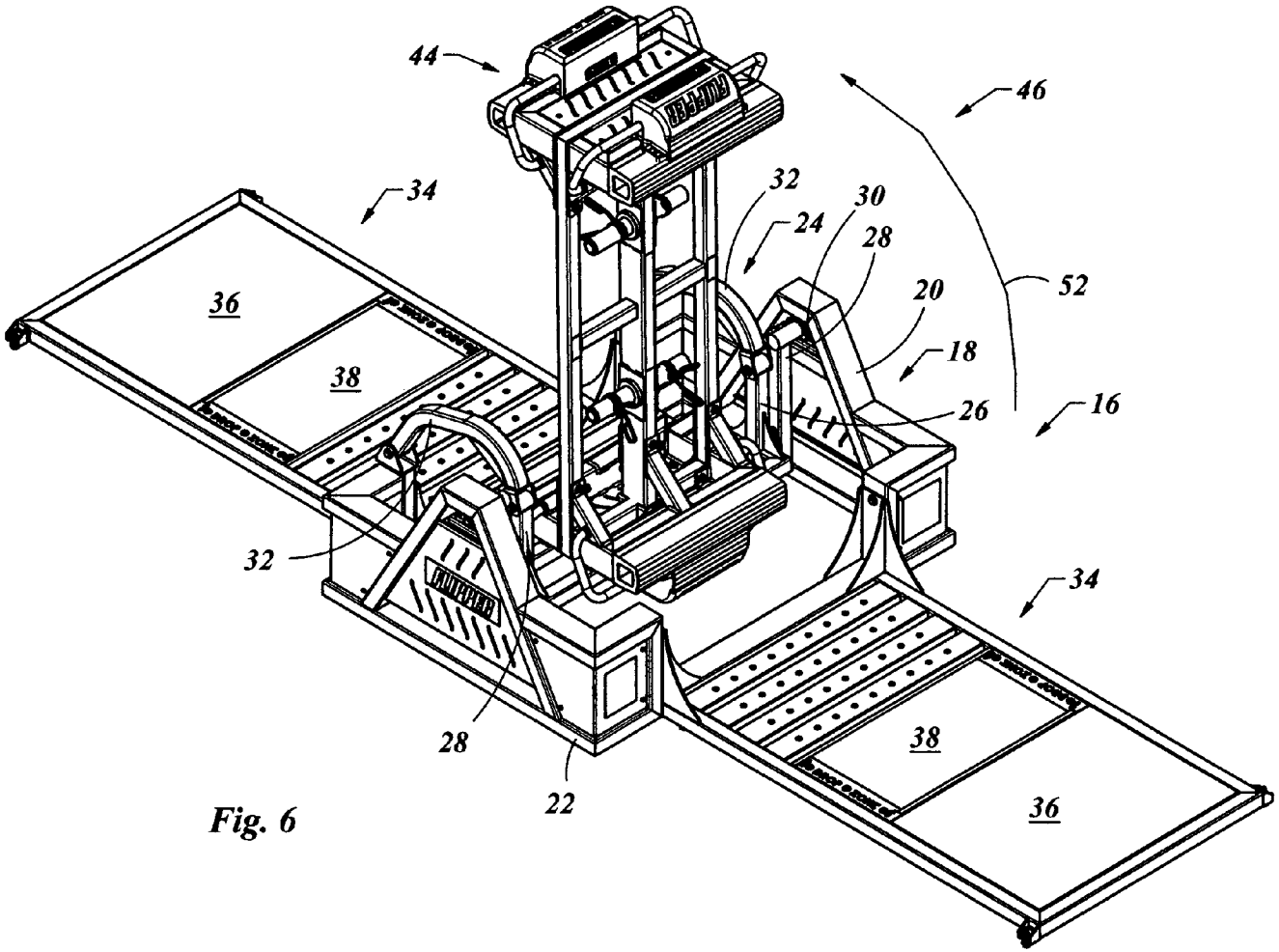
FIG. 6 is an isometric view of the device of FIG. 3 as it may be used with the exercise device passing approximately half way through its complete range of motion.

In FIG. 5, the free end of the exercise device 44 is shown to be elevated from the platform 34, as is depicted by the arrow 50. The user may continue to move the free end of the exercise device 44 upward, is depicted by the second arrow 52, as shown in FIG. 6. In this view is more clearly shown how the exercise device 44 may be secured to the mounting link 26 of the mounting frame 24. The swing link 28 of the mounting frame 24 may be journaled to the base frame 18 by the main bearing 30. This combination may provide inarticulate movement of the exercise device 44 as it rotates from one platform 34 up and potentially toward the platform 34 opposite to the platform 34 which supported the exercise device 44 in FIG. 4.

Figure 7:
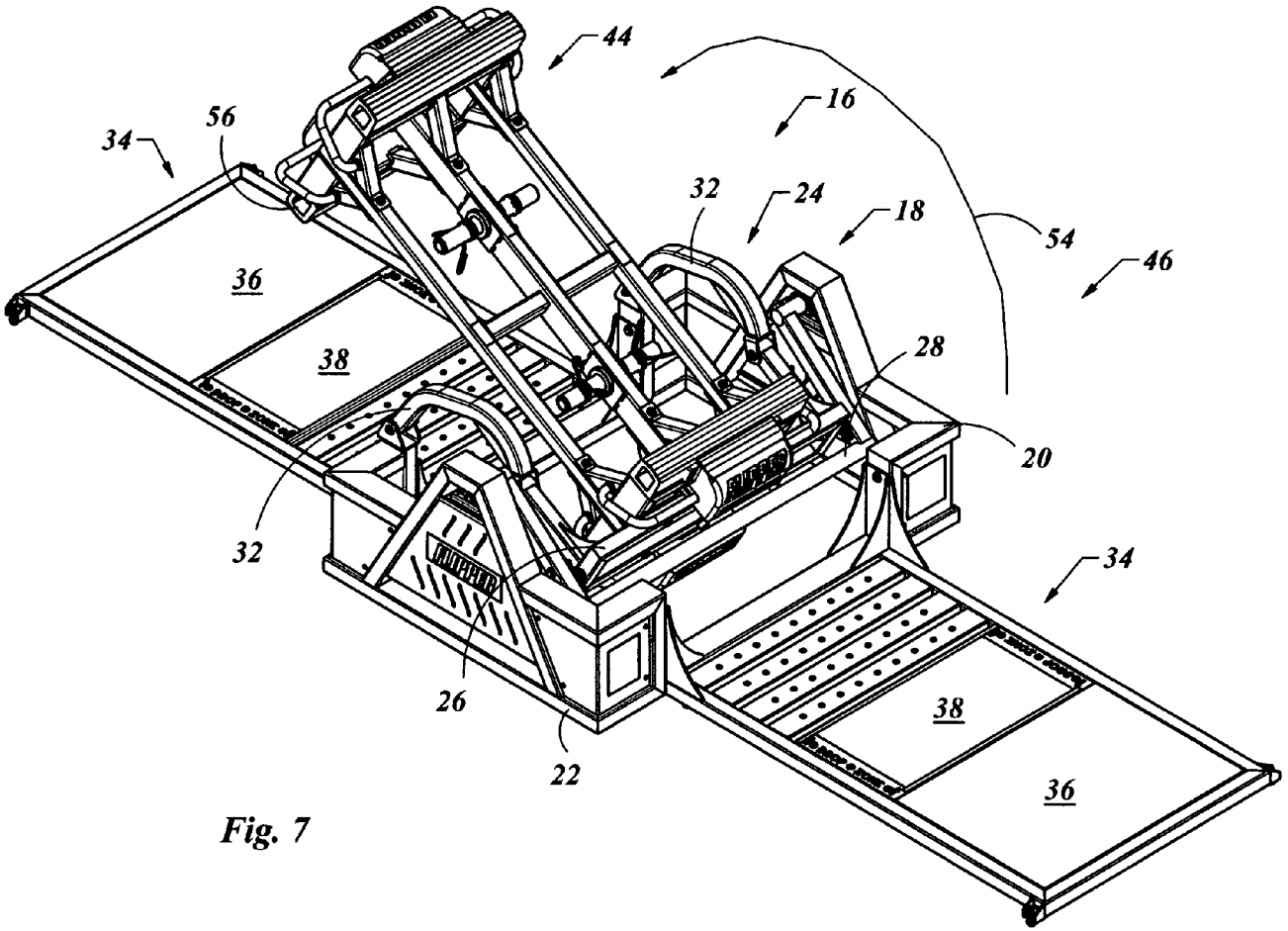
FIG. 7 is an isometric view of the device of FIG. 3 as it may be used with the exercise device passing over half way through its complete range of motion.
Figure 8:
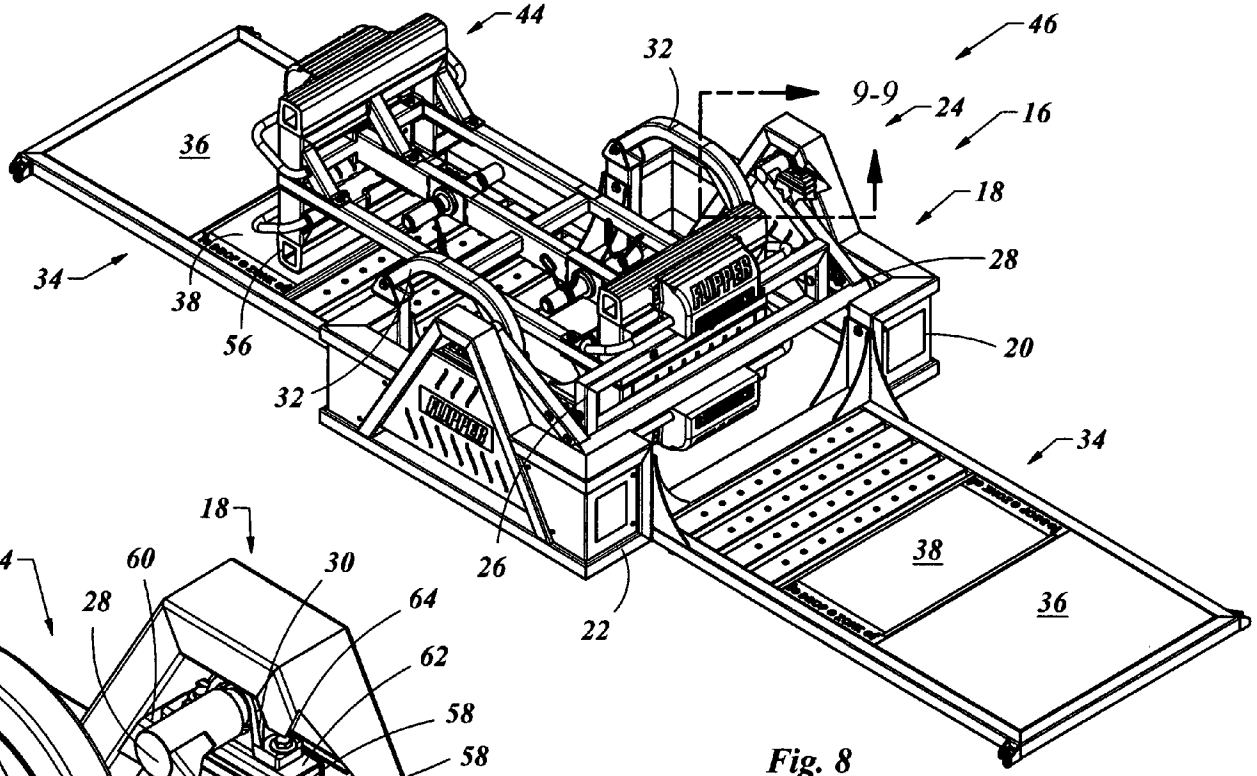
FIG. 8 is an isometric view of the device of FIG. 3 as it may be used with the exercise device passing through a range of motion to position the exercise device on the opposite side.

As the exercise device 44 moves past top dead center, as was shown in FIG. 6, the exercise device 44 may be positioned to fall toward the platform cushion 38 of the opposite platform 34, as is shown in FIG. 7. This movement of the exercise device 44 is illustrated by the third arrow 54. The bumper 56 of the exercise device 44 may contact the platform cushion 38 as is shown in FIG. 8. This sequence of lifting the exercise device 44 up and away from the platform 34, allowing the exercise device 44 to be explosively thrown, while still being controlled by the mounting frame 24 of the control system 16, provides a safe environment for the user to perform explosive power exercises.

Figure 9:
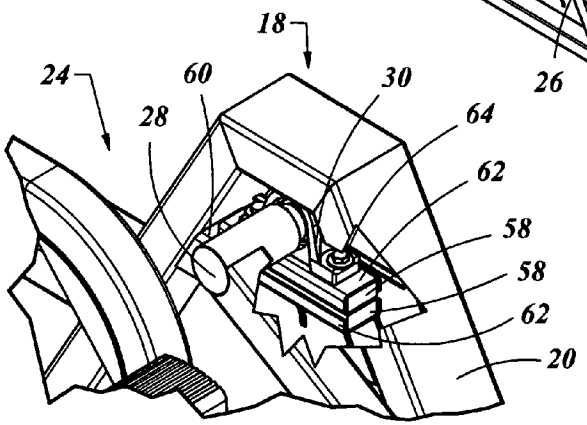
FIG. 9 is a detailed, cut away view along line 9-9 showing the bearing support of the mounting frame on a base frame.

FIG. 9 shows a detail of the right base frame 20 with a portion of the right base frame 20 cutaway to reveal the main bearings 30. In that the exercise device 44 may be ballistically thrown by the user, the base frame 18 should be adapted to deal with stress and vibration. One solution to aid in the damping of the vibration between the exercise device 44 and the base frame 18 is to provide a bearing damping mechanism between the bearing 30 in the base frame 18. In this view only the right base frame 20 is shown, but it is understood that the left base frame 22 may also include a similar damping mechanism as is shown here on the right base frame 20. In this embodiment, the right base frame 20 may include a frame channel 60. A bearing damper 58, which may be produced of a pliable material such as rubber, polyurethane, or a similar material, may be positioned on one side of or, as shown here, on the top and bottom of the frame channel 60. A damper plate 62 may be positioned on the bearing dampers 58 opposite to the frame channel 60. The purpose of the damper plate 62 is to provide a rigid contact material such that the bearing 30 and the fasteners 64 may relatively evenly distribute the load applied by clamping the bearing 30 to the frame channel 60 of the right base frame 20, through the bearing dampers 58. This combination removes any immediate contact between the swing link 28 of the mounting frame 24 and the right base frame 20. The mechanical communication between the main bearing 30, supporting the swing link 28, and the right base frame 20 passes through the bearing dampers 58. The compliant material of the bearing dampers 58 allows for a decreasing force due to an increase in time over which the impulse of the vibration transfers from the exercise device 44 impacting the platform cushion 38 of the platform 34 through to the base frame 18. By increasing the time duration of the impulse, the force is proportionately decreased, thus decreasing the shock load on the main bearing 30. This is not necessarily critical to the novelty of the invention as shown herein, but is considered a preferred embodiment providing for potentially increased cycle life of the control system 16.

Figure 10:
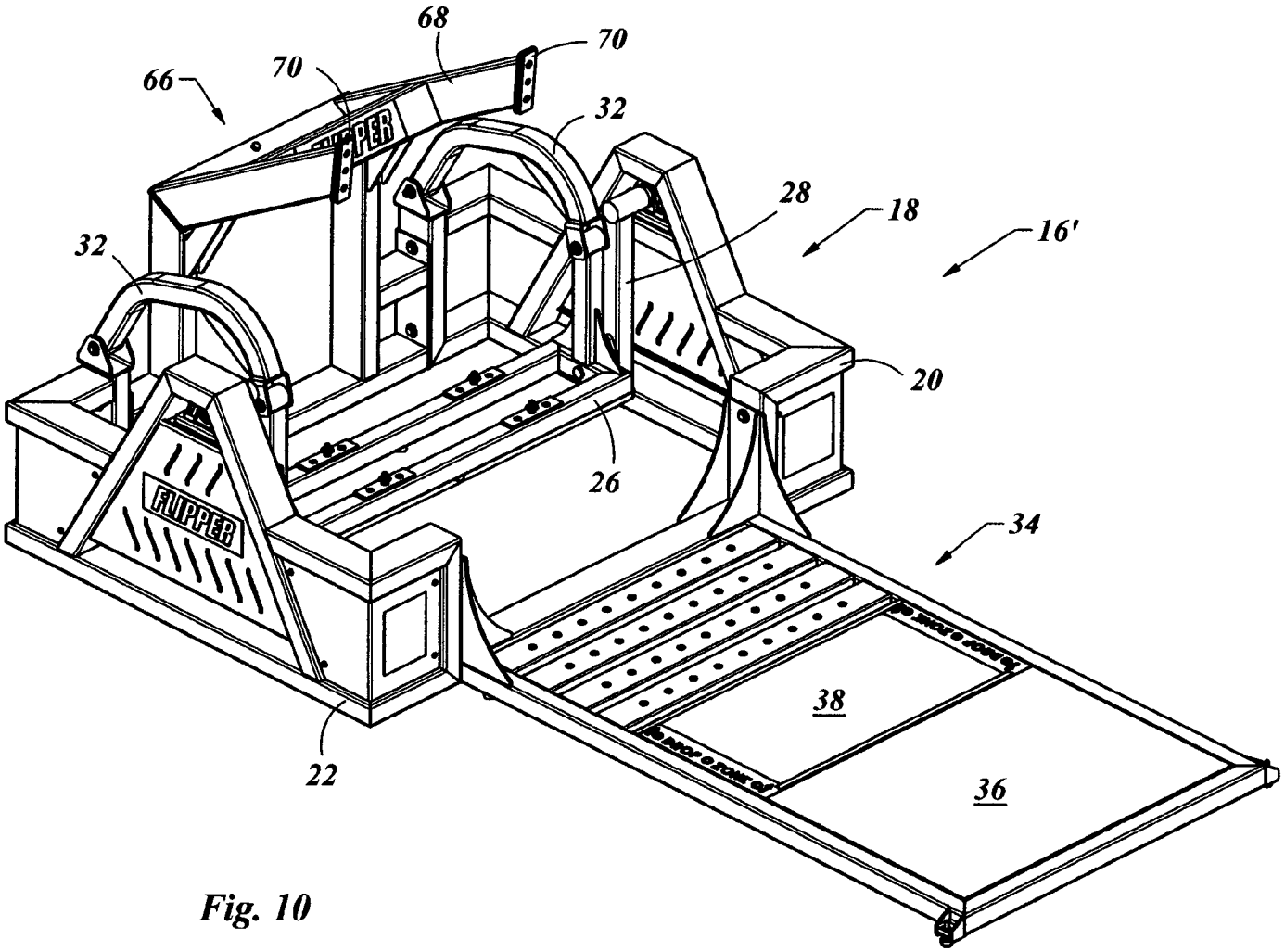
FIG. 10 is an isometric view of an alternative control system enabling a reduced range of motion of an exercise device which may be docked therein.
Figure 11:
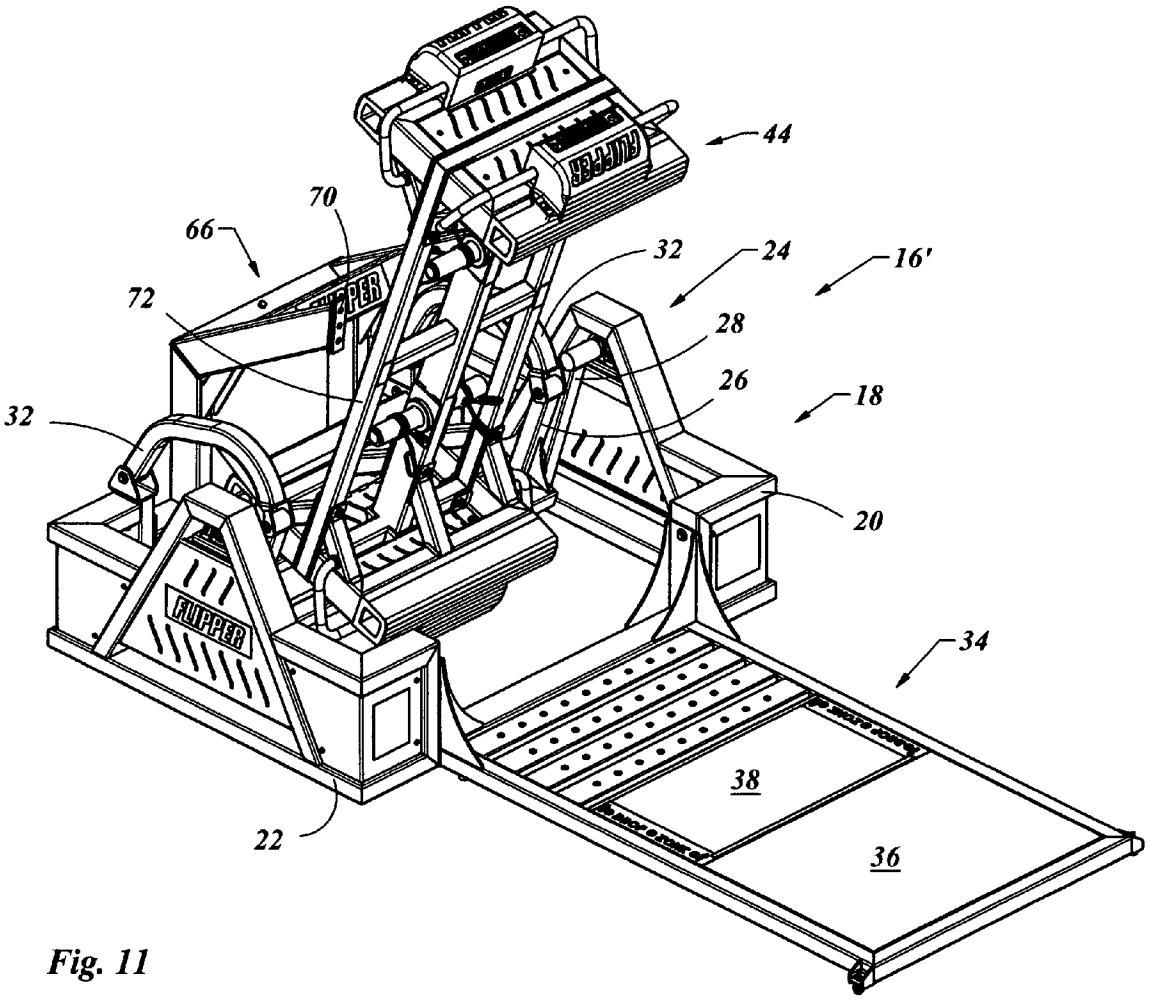
FIG. 11 is an isometric view of the control system of FIG. 10 with an exercise device docked therein and positioned to be shown passing through a portion of its range of motion.

An alternative embodiment of the control system 16' for an exercise device is shown in FIG. 10. In this form of the invention, a single platform 34 may be provided on one end of the base frame 18. On the opposite end of the base frame 18 a stop frame 66 is shown. The stop frame 66 may include one or more extension arms 68 with bumper stops 70 on a distal end. As is shown in FIG. 11, an exercise device 44 has been secured to the mounting frame 24, which is movably mounted to the base frame 18, similar to that as previously shown and described. In this view, the exercise device 44 has been elevated off the platform 34, as would be done by a user. The exercise device 44 may be moved up, toward a more vertical position until the center frame 72 of the exercise device 44 contacts the bumper stops 70 of the stop frame 66. This embodiment of the control system 16' does not allow the exercise device 44 to transition over approximately 180° as it did in the previous embodiment. This embodiment of the control system 16' may be suited for environments where less space is available. As such, this form of the control system 16' may be positioned with the stop frame 66 up against a wall or other object, taking up less space than the previously disclosed version of the invention 16.

In FIG. 12, a sequential depiction of an exercise system is shown with an exercise device 44 secured to a mounting frame 24. As previously shown the exercise device 44 is mounted to the mounting link 26. The mounting link 26 is pivotally coupled to the swing link 28, which is pivotally coupled to the base frame 18. In each of the views of FIG. 12, the left base frame 22 has been removed to more clearly show the mounting frame 24. Therefore, the base frame 18 will be considered analogous with the right base frame 20, and shown as such.

Figure 12A:
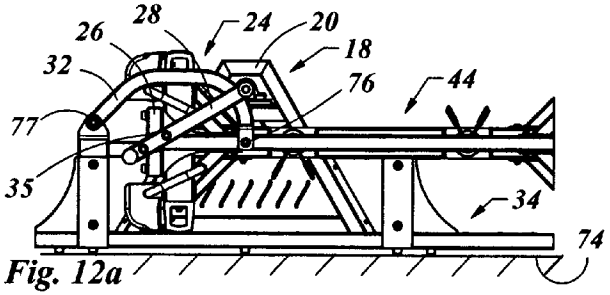
FIG. 12 is a sequential series depicting the movement of the mounting frame and the exercise device as the exercise device moves through approximately 90° of rotation relative to the base frame.
Figure 12B:
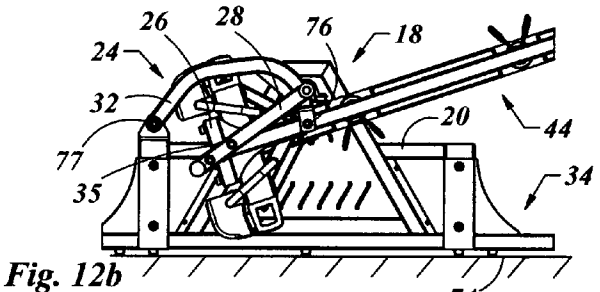
Figure 12C:
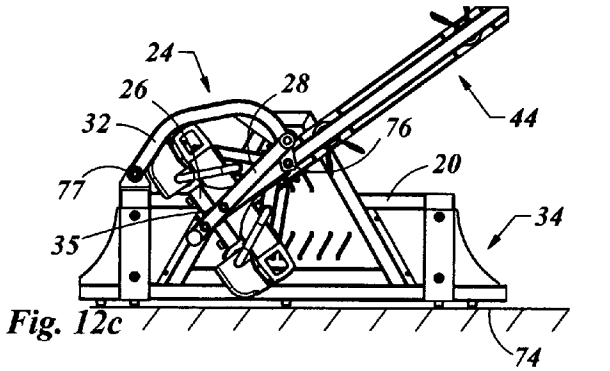
Figure 12D:
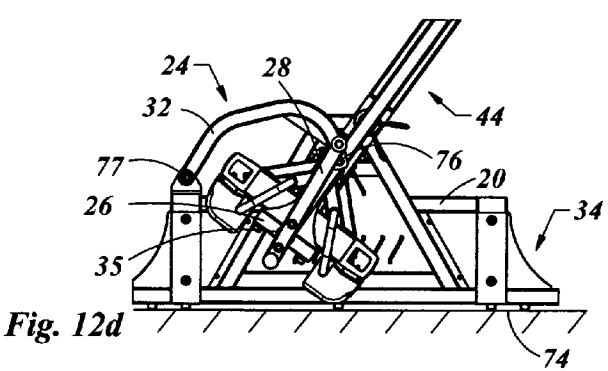
Figure 12E:
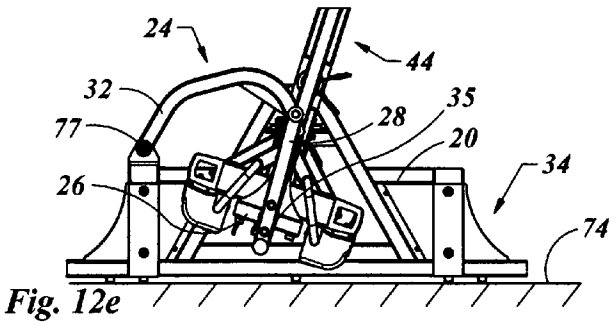
Figure 12F:
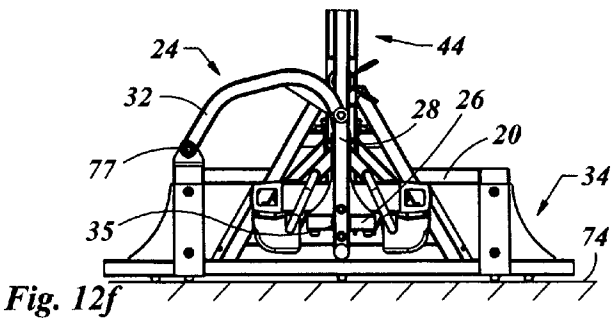

FIG. 12*a* is a cropped view of the exercise device 44 in a starting position as it may be resting on the platform 34. The exercise device 44 is shown in progressively increasing angles relative to the platform 34, as if the exercise device 44 was being lifted by a user, in FIGS. 12*b*-12*f*. Each figure sequentially increases the angle of the exercise device 44 relative to the platform 34 up to a substantially vertical position as shown in FIG. 12*f*. This sequence shows how the end of the exercise device 44, which is coupled to the mounting frame 24, is suspended off the ground 74 throughout the rotation and translation of the exercise device 44. The mounting link 26 directly supports the exercise device 44 and the swing link 28 supports the mounting link 26 to the base frame 18. The guide link 32 may provide a substantially vertical path of travel for the distal joint 76 of the mounting link 26. This combination provides a smooth rotation of the exercise device 44 while the end of the exercise device 44 which is mounted to the mounting link 26, maintains a reasonably consistent height off the ground 74, throughout the movement of the exercise device 44.

This controlled movement of the exercise device 44, as provided by the mounting frame 24 and supported by the base frame 18 (or in these views as illustrated by the right base frame 20), may be accomplished by the combination of elements of the mounting frame 24. More specifically, the exercise device 44 may be secured to the mounting link 26 by way of the mounting studs 33, making the exercise device 44 move consistently with the mounting link 26. The mounting link 26 may be constrained in more than one manner, first by a pivotal connection to the swing link 28 by way of the swing mount bearing 35, also shown in FIG. 3. The swing mount bearing 35 may pivotally couple the mounting link 26 to the swing link 28, which is in turn pivotally coupled to the base frame 18 by the main bearing 30 (FIG. 3).

If the mounting link 26 is pivotally coupled to the swing link 28, which is pivotally coupled to the base frame 18, the mounting link 26, and therefore the exercise device 44 mounted to the mounting link 26, would not move in any defined path, as there are too many unconstrained degrees of freedom. By restricting the movement of a portion of the mounting link 26 to a defined path, such as a substantially vertical path, the mounting frame 24 would be restricted to a defined movement as the mounting link 26 is articulated with respect to the base frame 18. This addition of a constraint may be accomplished by coupling the guide link 32 to the base frame 18 at the guide link joint 77 and also to the mounting link 26 at the distal joint 76. The guide link 32 may provide a set distance between the guide link joint 77 of the base frame 18 and the distal joint 76 of the mounting link 26. Though this is an arcuate path, as the guide link 32 is pivotally mounted to the base frame 18 at the guide link joint 77, if the distance between the distal joint 76 and the guide link joint 77 is significantly greater than the vertical displacement of the distal joint 76 during 90° of rotation of the mounting link 26, the horizontal displacement of the distal joint 76 may be insignificant to the proper function of the mounting frame 24, and therefore undetectable to a user. Another embodiment of the invention would be to provide a linear guide mounted to the base frame 18, receiving the distal joint 76 and restricting movement to a vertical path relative to the base frame 18. Though not shown, this modification would be considered a functional equivalent to the guide link 32 as shown and described herein.

Another advantage to the use of a control system 16, including the mounting frame 24 as shown and described herein, is further illustrated in FIG. 12. FIG. 12*a* shows what may be considered a starting position of the exercise device 44 as it would be controlled by the articulating mounting frame 24. As the exercise device moves up to the substantially vertical position of FIG. 12*f*, the end of the exercise device 44 mounted to the mounting frame 24, and therefore not lifted by the user, moves toward the user, as if the exercise device 44 were on a treadmill and as it is lifted, the treadmill is engaged to move the far end of the exercise device 44 toward the user. An advantage to this is the user does not need to step as far forward during the lifting process. In some cases the user does not need to move their feet at all during the completed movement including throwing the exercise device 44 over to the opposite side. This added stability may be desired as it may provide a safer condition for lifting as the lifter is less likely to lose their footing if their feet are not required to move. Also, this movement has the ability to mimic commonly performed lifts now used in the weight room involving Olympic style lifts such as the clean, power clean, hang clean and others where the lifter does not advance forward during the lift. As these are classically trained and commonly used lifts, it may be desirable to provide an alternative to performing these lifts while using the control system 16, a more stable device as opposed to a weighted bar with six degrees of freedom and a higher risk of missing a lift and injuring themselves or someone nearby.

Yet another advantage to using the control system 16 with the mounting frame 24 is, because the far end of the exercise device 44 moves toward the user as it is lifted, and also as it is extended over to the opposite side, the space requirement is decreased. If a single pivot system were used, the floor space requirement would be at least twice that of the length of the exercise device 44. With the control system 16 as shown and described, the far end of the exercise device moves toward the user as the exercise device 44 is moved, thus making the necessary space less than twice the length of the exercise device 44. This may have benefits when floor space is limited or expensive.

Figure 13:
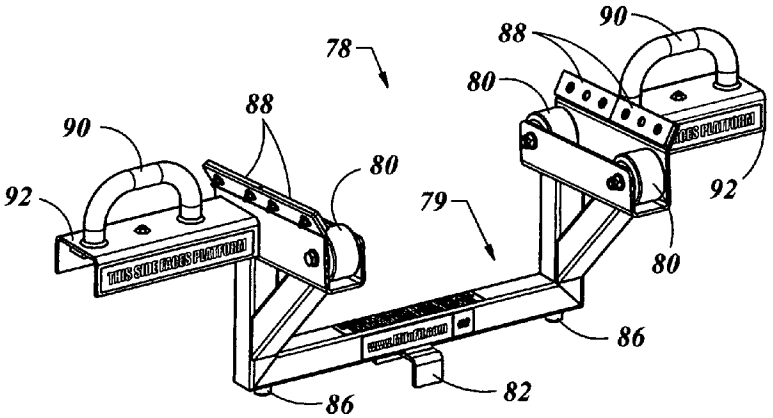
FIG. 13 is an isometric view of a loading assistant which may be used in conjunction with the control system of FIG. 1.
Figure 14:
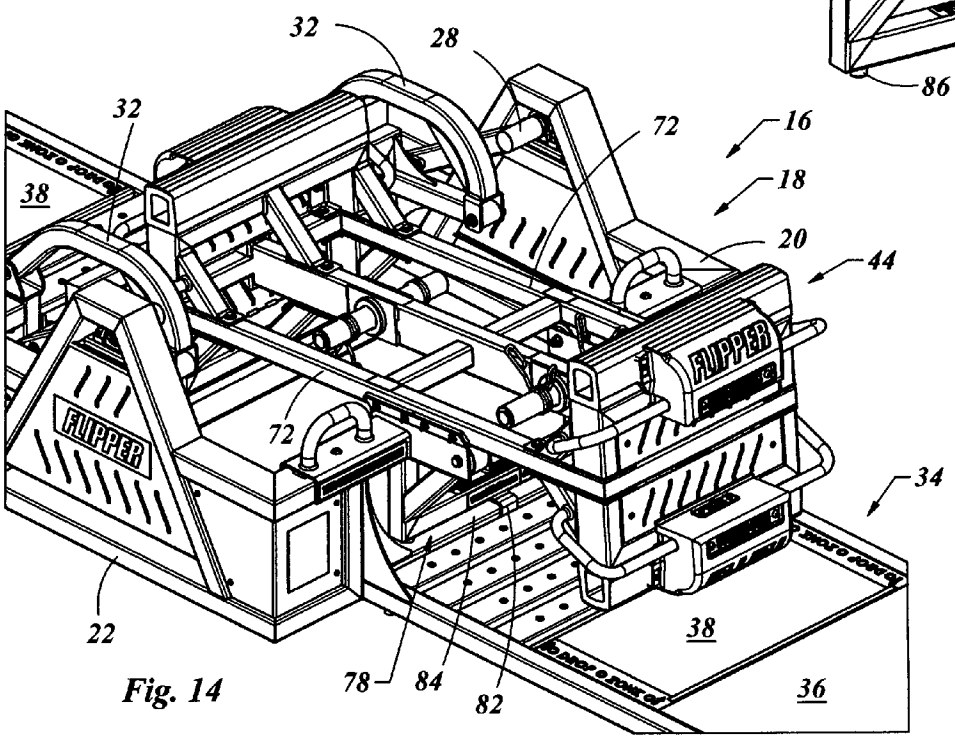
FIG. 14 is an isometric view of the control system and the exercise device of FIG. 4, with the loading assistant of FIG. 13 as it may typically be used.

The control system 16 may be provided in a form that the exercise device 44 may be selectively docked or undocked from the control system 16. In that the exercise device 44 may have any substantial amount of weight, it may be desirable to provide a mechanism to assist with the docking and undocking of the exercise device 44 into and out of the control system 16. Such a loading assistant 78 is shown in FIG. 13 and as it may typically be used in FIG. 14. The loading assistant 78 may include a frame 79 which supports two or more rollers 80, which may be used to support the center frame 72 of the exercise device 44. On a lower portion of the frame 79 a guide stop 82 may be provided to receive the cross beam 84 of the platform 34. Support bumpers 86 may also be provided on a lower portion of the frame 79 of the loading assistant 78. The support bumpers 86 may rest upon the cross beam 84 of the platform 34, thus providing a compliant support so as not to damage the platform 34 under the weight of the loading assistant 78. Adjacent to the rollers 80, guide blocks 88 may be provided to offer guided support to the exercise device 44 when moving on the rollers 80 of the loading assistant 78 into or out of the control system 16.

Adjacent to the guide blocks 88 may be provided one or more handles 90. These handles 90 may be used to transport the loading assistant 78 into and out of the control system 16. The handles 90 may be mounted to the top channels 92 which, when placed onto the control system 16, the top channels 92 may receive an upper portion of the base frame 20. To dock or undock an exercise device 44 into the control system 16, a user may position the center frames 72 of an exercise device 44 on the rollers 80, captured between the guide blocks 88. The exercise device 44 may move with the center frame 72 of the exercise device 44 on the rollers 80 in a slightly inclined position. It may be desirable for the centerline of the axes of the rollers 80 to be slightly inclined with respect to a portion of the frame 79. This incline may be consistent with the angle of the exercise device 44 relative to the platform 34 when the exercise device 44 is secured to the mounting frame 24. This angle of incline may position the exercise device 44 in the proper position such that the exercise device 44 may be moved into the mounting frame 24 when the mounting frame 24 is rotated relative to the base frame 18 so as to be aligned with and therefore receive the exercise device 44.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. An exercise system, comprising:

an exercise device of the type including a frame with a longitudinal center section, defining a first end and a second end coupled to two substantially equal end sections, one of each of the end sections coupled to the first end and the second end respectively of the longitudinal center section substantially at a midpoint of each of the end sections; a pin coupled to the longitudinal center section, the pin adapted to receive a weight plate; and a bumper coupled to each of a top portion and a bottom portion of each of the two end sections, whereby the exercise device may be supported on two of the bumpers;

a mounting frame adapted to receive the exercise device; and a base frame adapted to receive the mounting frame while providing articulate communication between the base frame and the mounting frame.

2. The exercise system of claim 1, further comprising a platform mounted to the base frame, the platform adapted to support a user.

3. The exercise system of claim 2, wherein the platform is comprised of a platform cushion positioned to contact the bumper of the exercise device.

4. The exercise system of claim 3, wherein the platform cushion is comprised of a resilient mat coupled with a foam cushion.

5. The exercise system of claim 1, further comprising a deck mounted to the platform, the deck adapted to support the weight of a user.

6. The exercise system of claim 1, wherein the mounting frame is comprised of:

a swing link coupled to the base frame;

a mounting link coupled to the swing link; and a guide link coupled to the base frame and the mounting link, thereby restricting a portion of the mounting link to a substantially vertical movement.

7. The exercise system of claim 6, wherein the mounting link comprises a mounting stud, adapted to secure the exercise device thereto.

8. The exercise system of claim 1, wherein the mounting frame provides articulate communication between the base frame and the mounting frame by way of a bearing supported on a bearing damper.

9. The exercise system of claim 8, wherein the bearing damper is comprised of a compliant material.

10. The exercise system of claim 8, further comprising a bearing mounted to two bearing dampers capturing a portion of the base frame.

11. A method of exercise for use with an exercise device including a frame with a longitudinal center section, defining a first end and a second end coupled to two substantially equal end sections, one of each of the end sections coupled to the first end and the second end respectively of the longitudinal center section substantially at a midpoint of each of the end sections; a pin coupled to the longitudinal center section, the pin adapted to receive a weight plate; and a bumper coupled to each of a top portion and a bottom portion of each of the two end sections, whereby the exercise device may be supported on two of the bumpers; a mounting frame adapted to receive the exercise device; and a base frame adapted to receive the mounting frame while providing articulate communication between the base frame and the mounting frame, the method of exercise including the steps of:

a user grasping the exercise device;

lifting one end of the exercise device by the user, while an opposite end is guided by the mounting frame; and flipping the exercise device over to a side opposite to the user, the exercise device being guided by the mounting frame.

* * * * *